US005810515A

United States Patent [19]

Fredriksen et al.

[11] Patent Number: 5,810,515

[45] Date of Patent: Sep. 22, 1998

[54] PROTECTIVE DEVICE FOR AN INSTALLATION MOUNTED ON THE SEABED

[75] Inventors: Kaj Hugo Fredriksen, Sandefjord; Olav Inderberg, Kongsberg, both of Norway

[73] Assignee: Kongsberg Offshore a.s, Kongsberg, Norway

[21] Appl. No.: 696,950

[22] PCT Filed: Feb. 21, 1995

[86] PCT No.: PCT/NO95/00039

§ 371 Date: Oct. 10, 1996

§ 102(e) Date: Oct. 10, 1996

[87] PCT Pub. No.: WO95/22680

PCT Pub. Date: Aug. 24, 1995

[30] Foreign Application Priority Data

Feb. 22, 1994 [NO] Norway ..... 940607

[51] Int. Cl.[6] ..... E21B 33/037

[52] U.S. Cl. ..... 405/211; 405/204; 166/356

[58] Field of Search ..... 405/211, 212, 405/216, 195.1, 204, 203, 224, 227; 166/356

[56] References Cited

U.S. PATENT DOCUMENTS

| | | | |
|---|---|---|---|
| 4,273,472 | 6/1981 | Piazza et al. | 405/211 |
| 4,519,727 | 5/1985 | Mitchell et al. | 405/211 X |
| 4,558,973 | 12/1985 | Blandford | 405/211 X |
| 5,176,471 | 1/1993 | Frafjord et al. . | |

FOREIGN PATENT DOCUMENTS

| | | |
|---|---|---|
| 0 139 438 | 5/1985 | European Pat. Off. . |
| 0 411 967 | 2/1991 | European Pat. Off. . |
| 174 476 | 1/1994 | Norway . |
| 2 226 352 | 6/1990 | United Kingdom . |

*Primary Examiner*—Tamara L. Graysay
*Assistant Examiner*—Frederick L. Lagman
*Attorney, Agent, or Firm*—Young & Thompson

[57] ABSTRACT

A means (20) for protecting a device (2) which a installed on the sea bed (11) and projects up therefrom. The means comprises a central section (21) which is arranged to be attached to the upper section (9) of the device (2), and legs (22) which are linked to the central section (21) and arranged to extend away from it and slantingly down to the sea bed (11). The legs (22) can be pivoted into a position, wherein their longitudinal direction is substantially coincident.

3 Claims, 3 Drawing Sheets

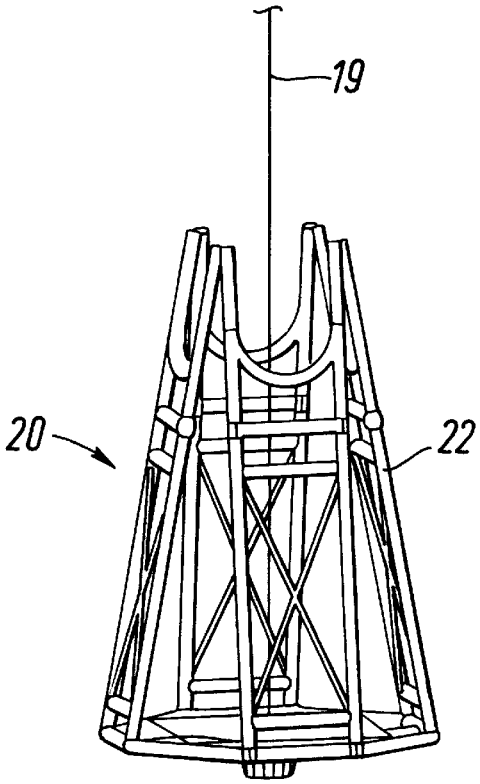
Fig. 1
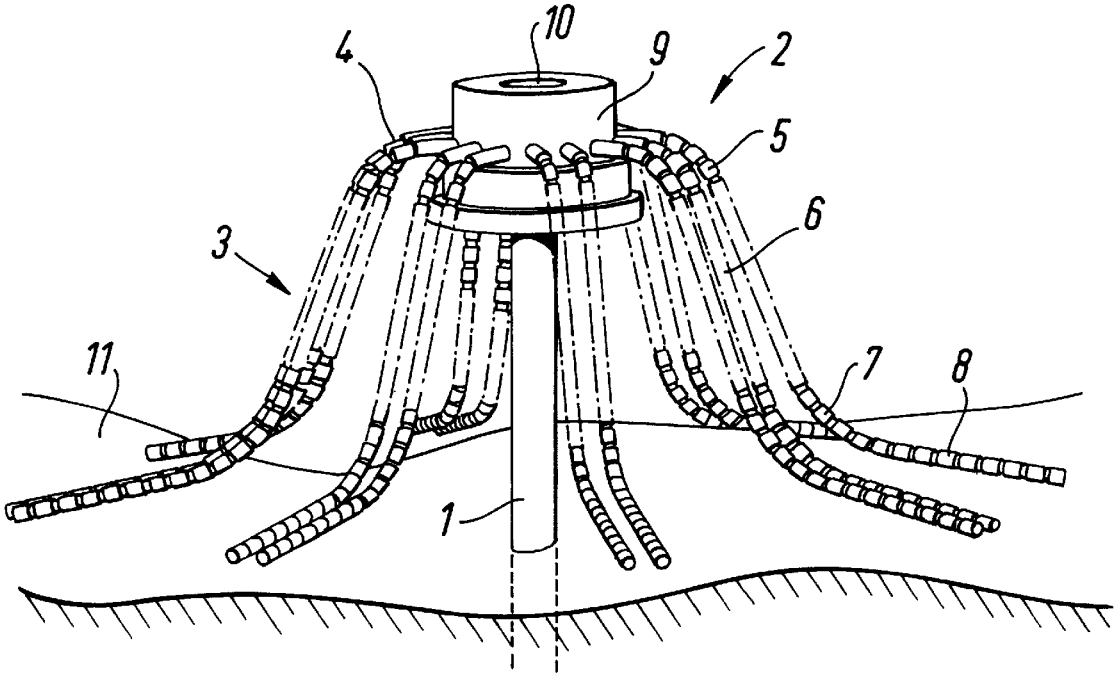

PROTECTIVE DEVICE FOR AN INSTALLATION MOUNTED ON THE SEABED

The invention relates to a protective means for a device which is installed on the sea bed, and which has an upper section which projects up therefrom, wherein the protective means is arranged to be lowered from a vessel down to the device, and comprises a central section and elongated elements which are linked with the central section and arranged to extend away from it and slantingly down to the sea bed when the protective means is protecting the device.

Within the field of oil production at sea, it is known that devices can be installed on the sea bed, e.g. wellhead Christmas trees, manifolds, etc. The upper section of such a device can be located 5–6 meters above the sea bed, and pipes can extend from the device down to the sea bed and continue away from it.

Such devices can be affected and damaged by objects which are towed by ships, e.g. objects which are used in connection with oil production, but also objects which are not used in this connection, such as trawl bags and the like.

For protection of a device of this type on the sea bed it is disclosed, e.g. in GB 2 226 352 and EP 0 411 967 that there can be provided outside the device a separate framework substantially in the form of a truncated pyramid, and which has an upper central section, e.g. in the form of the upper, small end surface of the truncated pyramid, and elongated elements which can extend along, e.g., the lateral edges of the pyramid down to a lower framework section in the form of the large end surface of the pyramid, the framework's elements hereby covering and protecting the device inside. When, e.g., a trawl bag is towed and comes into contact with such a frame, the trawl will merely slide over it without the risk of becoming entangled in protruding components of the device. Damage to both the device and the trawl are thereby prevented.

An auxiliary craft is used to mount the framework. The framework takes up a great deal of space on board the vessel, and since the large lower end surface of the framework is larger than the moon pool with which such ships are provided, and through which other equipment such as diving bells etc. can be lowered, the framework has to be lowered along the outside of the ship, which is a cumbersome process.

In EP 0 139 438 it is further disclosed that elongated elements of a protective means can be linked with a carrier part of the protective means, thus enabling the elements to be tilted from a position in which they extend approximately vertically, to a position in which they extend slantingly downwards and away from the upper section of the carrier part. This entire structure is so large that it has to be assembled below the device whereby the structure is lowered to the sea bed. Since the known protective means are intended to be secured to the sea bed by means of piles, but otherwise are self-supporting, they are large and heavy.

The object of the invention is to provide a means of the type mentioned in the introduction which is not encumbered by the above-mentioned disadvantages.

The invention will now be described in more detail with reference to the drawing which schematically illustrates two embodiments of a structure according to the invention.

FIG. 1 is a perspective view of a first embodiment of a means according to the invention, this structure being suspended in a hoisting line above a device which is permanently installed on the sea bed.

Figure 2:
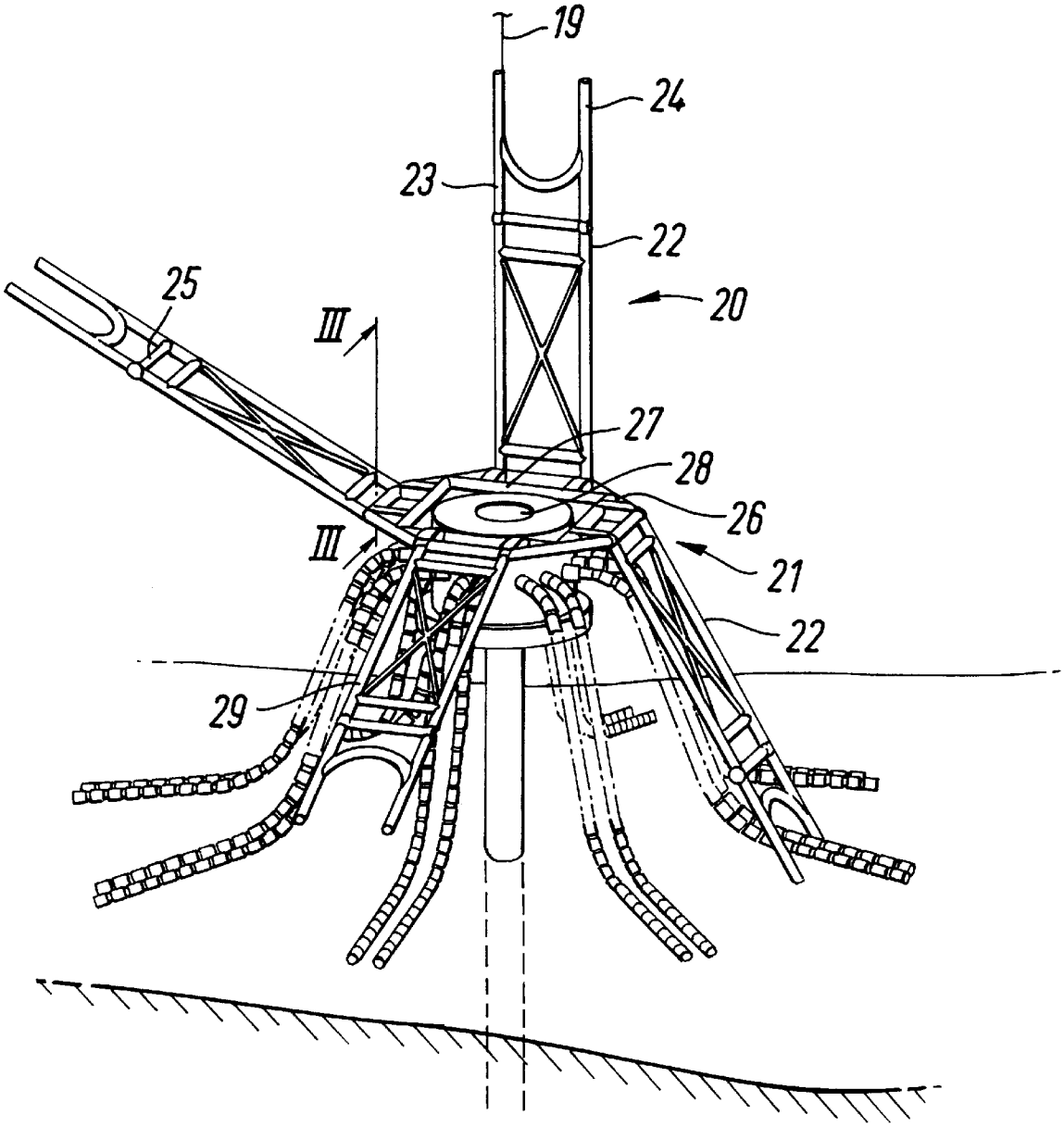
FIG. 2 is a perspective view of the structure illustrated in FIG. 1, with some of its legs pivoted into a position, wherein they project into the sea bed.

As illustrated in FIG. 1 there projects up from the sea bed a pipe 1 which is permanently connected to the sea bed 11. To the upper end of the pipe there is attached a manifold 2, from which pipelines 3 extend substantially radially. Closest to the manifold 2 each pipe has a first pipeline section 4 which extends substantially horizontally in relation to the manifold 2. At some distance from the manifold the first pipeline section passes via a first bend 5 on to a second pipeline section 6 which extends slantingly down to the sea bed. The second pipeline section 6 then passes via a second bend 7 near the sea bed on to a third pipeline section 8 which is resting on the sea bed and extends substantially horizontally away from the manifold 2. The manifold 2 and the first and second pipeline section 4 and 6 respectively of the pipes thus approximately define a truncated pyramid or cone.

The upper section 9 of the manifold 2 projects slightly above the first pipeline sections 4 and has a centring and securing device 10.

From an auxiliary craft (not shown) a structure 20 is lowered via a hoisting line 19 for protection of the manifold 2 and the pipeline sections 4,5,6,7 which are located closest to the manifold.

As is best illustrated in FIG. 2 the structure has a central section 21 in the form of a flat, regular, octagonal framework with side elements 26 and additional bracing elements 27 which carry a central centring and securing device 28, which is arranged for centring in relation to the manifold's centring and securing device 10. The side elements 26 and the bracing elements 27 extend in the same plane and are composed preferably of pipe pieces whose end sections are welded together.

It should be understood that the largest diameter of the central section 21 of the structure 2 is smaller than the diameter of the ship's moon pool.

To the side elements of two opposing pairs of side elements 26 there are linked respective, elongated elements or legs 22, these being capable of pivoting around the associated side elements 26.

Figure 3:
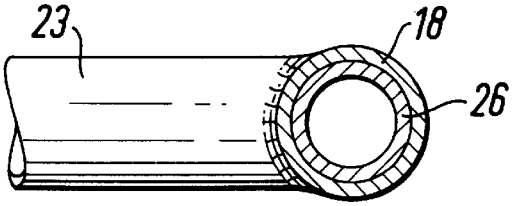
FIG. 3 is a section along the line III–III in FIG. 2

Each leg comprises two side members 23,24 which are connected to each other by means of a number of transverse struts 25, which extend in the same plane as the side members 23,24, and at the end of the side members which is located closest to the central section 21, the side members 23,24 are welded to a pipe 18, which is passed with clearance around the associated side element 26 as illustrated in FIG. 3.

At the free end section of the legs, the side members are not connected together via transverse struts and therefore project in the form of a rod away from the central section.

The method of operation of the means is as follows.

On board the ship the structure can be stored with its legs 22 pivoted into the position which is illustrated in FIG. 1. Thus it takes up little space, and the legs extend substantially in the same direction in relation to the central section 21. This figure illustrates that a projection of the legs in this direction towards the plane in which the central section extends, i.e. the direction in which the hoisting line 19 extends, lies within the contour of the central section 21. Since the central section 21 of the structure is dimensioned in such a way that its largest diameter is smaller than the diameter of the ship's moon pool, the structure can be lowered through it when it is suspended from the hoisting line 19.

After the central section 21 of the structure 20 and the upper section 9 of the manifold 2 have been centred in relation to each other and these sections have been permanently connected to each other via the centring and securing devices 10 and 28 respectively, the legs 22 are pivoted down to the sea bed 11 to the position which is illustrated at the leg 29 in FIG. 2, the free end sections of the legs' side members 23,24, i.e. the legs' feet, hereby penetrating deep down into the sea bed 11 and thereby ensuring that they are securely anchored to the sea bed 11. Finally the hoisting line 19 is disconnected from the structure 20, whereupon it is pulled up to the ship.

When the structure 20 has to be removed from the manifold 2, the hoisting line 19 is once again paid out from the ship and connected to the central section 21 of the structure. The connection between the central section 21 and the upper section 9 is then severed, whereupon tension is exerted on the hoisting line 19 causing the legs 22 to be pulled up from the sea bed 11. After being pulled up the legs 22 can remain suspended vertically down from the central section 21 and can be raised in this position if there is no risk of their snagging on or damaging the manifold during the lifting operation. Since a projection of the legs in the same direction towards the plane in which the central section 21 extends, even when the components of the structure are in this position relative to one another, does not lie outside the contour of the central section 21, the structure can finally be hoisted aboard the ship via its moon pool. Alternatively the legs can be tilted up, e.g. to the position which is illustrated in FIG. 1.

Figure 4:
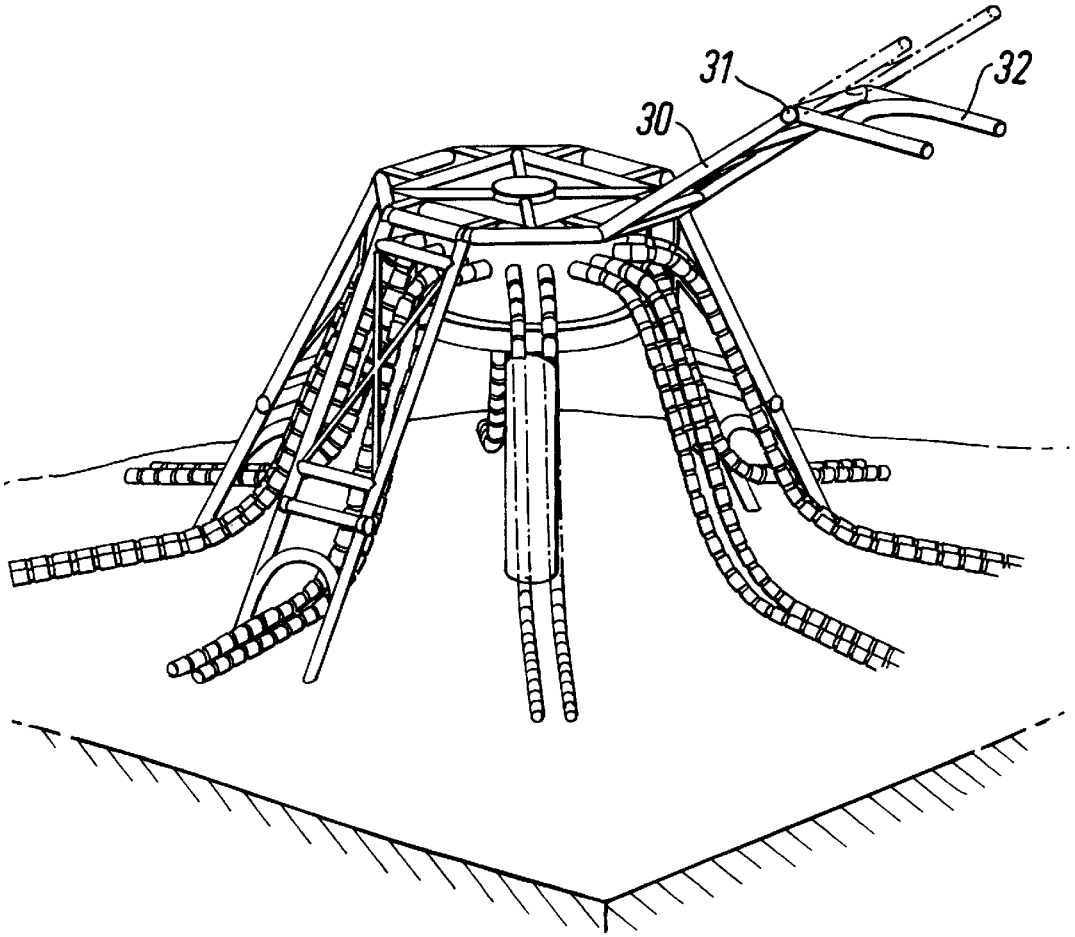
FIG. 4 is a perspective view of a second embodiment of the structure according to the invention.

When the legs 22 are being withdrawn from the sea bed, however, the legs 22 extend slantingly in relation to the line's longitudinal direction. Thus the resistance exerted by the legs during the lifting operation can be relatively great. FIG. 4 shows a second embodiment of the structure according to the invention which enables this resistance to be reduced. At a section which will be located close to, but above the sea bed 11 when the structure is mounted on the manifold 2, the legs 30 have a knee 31. Thus the lower section or foot section 32 of the legs which is pressed down into the sea bed can, during the first phase of the lifting operation, be rotated into a position, in which it extends substantially in the direction of the pull in the line 19, and therefore exerts minimal resistance during the lifting process from the sea bed 11.

The knee can have a known per se blocking device (not shown) which restricts the extent of the knee's angular rotation, thus enabling it to be rotated from the bent position to the position which is illustrated by dotted lines in FIG. 4, wherein the foot is aligned with the rest of the leg, but no more.

It is particularly useful to have a leg with a knee joint in those cases where the structure according to the invention is not required to be raised, but where only temporary access is required to couplings, control panels etc. of the manifold which is located under one of the legs, after which the leg concerned is tilted down again. In this case use can be made, e.g., of a remotely controlled subsea vessel which grasps the leg and pivots it up about its axis of rotation. The knee joint hereby enables an initial rotation of the foot about its central section and lateral displacement and compression of the adjacent ground, thus giving a clearance between the foot and the sea bed which permits water to flow in under the foot, equalizing the underpressure which would otherwise have been created during the lifting operation. The continued rotation of the leg 30 can thus be performed with the exertion of a minimal lifting force.

It has been stated in the above that the device which is permanently connected to the sea bed is a manifold, but it should be understood that other devices which project up from and are permanently connected to the sea bed can also be provided with a protective means according to the invention.

Even though it has been stated in the above embodiments that the legs face the same way in relation to the central section during lowering and raising, it is obvious that the means can also pass through the moon pool if one or more legs face the other way in relation to the other legs. Similarly it should be understood that the link can be formed in a different way to that described in the above, and a person skilled in the art will be able to choose the most suitable method.

Furthermore, it is stated in the embodiments that the central section 21 is in the form of a regular octagon, but it will be understood that other shapes are also possible for this central section. Moreover, the legs can be of different lengths, and the hinge axes do not require to extend in the same plane.

It should also be understood that instead of comprising two side members the legs can comprise only one longitudinal element and, e.g., be connected to the central section via a ball joint connection, whereby the exact movement of the legs in relation to the central section can be determined after the structure has been connected to the device which is permanently installed in the sea bed.

By means of the structure according to the invention the central section 21 can be connected to the device on the sea bed. By utilizing this device in this manner to support the protective means, the latter can be light and so small that it can be passed in its assembled condition through the moon pool of a ship, and this facilitates the installation of the protective means on the sea bed.

We claim:

1. In a protective means (20) for a device (2) which is installed on the sea bed, and which has an upper section (9) which projects up therefrom, wherein the protective means (20) is arranged to be lowered from a vessel down to the device (2), and comprises a central section (21) and elongated elements (22, 30) which are linked to the central section (21) and arranged to extend away from it and slantingly down to the sea bed (11) when the protective means is protecting the device (2); the improvement wherein the central section (21) has a securing device (28) that secures the central section (21) to the upper section (9), and that supports the central section (21) and thereby the elements (22, 30).

2. A protective means according to claim 1, characterized in that free end sections of the elements (22,30) are arranged to be driven into the sea bed for further support of these elements (22,30) and the central section (21).

3. A protective means according to claim 2, characterized in that an element section (32) which is located close to a free end of the elements (30) is linked to an element section which is directly linked to the central section (21), axes of rotation of a same element (30) extending parallel to each other.

* * * * *